US007510016B2

(12) United States Patent
Telfer

(10) Patent No.: US 7,510,016 B2
(45) Date of Patent: Mar. 31, 2009

(54) PACKER

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 123 days.

(21) Appl. No.: 11/579,555

(22) PCT Filed: May 3, 2005

(86) PCT No.: PCT/GB2005/001684

§ 371 (c)(1),
(2), (4) Date: Nov. 3, 2006

(87) PCT Pub. No.: WO2005/106189

PCT Pub. Date: Nov. 10, 2005

(65) Prior Publication Data

US 2007/0221372 A1 Sep. 27, 2007

(30) Foreign Application Priority Data

May 5, 2004 (GB) ..... 0409964.4

(51) Int. Cl.
*E21B 33/1295* (2006.01)

(52) U.S. Cl. ..... 166/387; 166/120; 166/129

(58) Field of Classification Search ..... 166/120, 166/129, 386, 387
See application file for complete search history.

(56) References Cited

U.S. PATENT DOCUMENTS

| | | | | |
|---|---|---|---|---|
| 3,112,795 | A * | 12/1963 | Keithahn | 166/120 |
| 3,223,169 | A * | 12/1965 | Roark | 166/120 |
| 3,826,307 | A | 7/1974 | Brown et al. | |
| 5,141,053 | A | 8/1992 | Restarick et al. | |
| 2003/0201102 | A1 | 10/2003 | Mackenzie et al. | |

FOREIGN PATENT DOCUMENTS

GB 2 280 461 2/1995

OTHER PUBLICATIONS

International Search Report for PCT/GB2005/001684 mailed Aug. 11, 2005 (2 pages).

* cited by examiner

*Primary Examiner*—Giovanna C Wright
(74) *Attorney, Agent, or Firm*—Osha • Liang LLP

(57) ABSTRACT

There is disclosed a downhole packer for use in a well bore, and in particular, a packer which can be used for downhole testing. In an embodiment of the invention, a packer tool (10) for mounting on a work string to provide a seal against a tubular (32) is disclosed, the packer tool comprising a body (12) with one or more packer elements (18) and a sleeve (14), the packer tool being set by movement of the sleeve relative to the tool body compressing the one or more packer elements, wherein the tool has a plurality of bypass channels (16) to provide a fluid path past the packer elements, the sleeve including at least owe anchoring member (22, 50), the at least one anchoring member being actuate to contact the tubular by fluid pressure from the bypass channels when the packer is set.

25 Claims, 2 Drawing Sheets

PACKER

BACKGROUND OF THE INVENTION

The present invention relates to a downhole packer for use in a well bore. More particularly, the present invention relates to a packer which can be used for downhole testing.

During well completions it is desirable to check the integrity of the production bore and any packers used to isolate portions of the well. A known technique for this is to perform an in-flow or negative test. One or more packers are inserted into the well bore to seal off a portion of the well. Low density fluid is introduced to the work string reducing hydrostatic pressure within the pipe. As a consequence of the drop in hydrostatic pressure, well bore fluid flows through any cracks or irregularities into the bore resulting in an increase in pressure which can be monitored and used to indicate where repairs are necessary.

Typically, a separate trip is required to be made into the well to perform an in-flow or negative pressure test. This is because the conventional packer tools used are set by a relative rotation within the well bore. As many other tools are activated by rotation and indeed as the drill string itself would normally be rotated during this type of operation, it is likely that the packer would prematurely set. This problem has been overcome by the introduction of a weight set packer. Such a weight set packer, referred to as a compression set packer, is disclosed in the Applicant's International Patent Application, publication no. WO/0183938. The packer is set by a sleeve moveable on a body of the packer being set down on a formation in the well bore. Movement of the sleeve compresses one or more packing elements to provide a seal.

This compression set packer is particularly suitable for integrity testing of a liner when a permanent packer, or 'tie-back' packer, with a Polished Bore Receptacle (PBR) has been used. Once the permanent packer with the PBR has been set, a single trip can be made into the well to operate clean-up tools and perform an in-flow or negative test. The clean-up tools may be operated by relative rotation of the work string in the well-bore and further the work string can be slackened off so that the sleeve of the compression set packer lands out-on the PBR. This sets the compression set packer above the PBR and seals the bore between the packers. An in-flow or negative test can then be performed.

A significant disadvantage of this compression set packer is that of loading on the PBR. When an in-flow test is carried out large pressure differentials are created across the packing element and thus a substantial force is applied to the packer from above. In a compression set packer much of this force is transferred to the PBR. As a result, both the packer element and the PBR are at risk of failure if the load bearing capacity is exceeded. This is a particular problem in deep wells were the differential pressures will be greater. For example, if a packer has an annulus surface area, in use, of 10 square inches and a pressure differential applied across it of 30,000 pounds, this provides a force of up to 250,000 pounds at the compression set packer.

The problem of excessive loading and the additional forces on the liner by the hydraulic test pressure differentials has been considered for a liner top test packer as described in WO 03/067027. This discloses an arrangement where the slips are set below a compression set packer and the packer is set against the slips. The additional loading and forces are all then transferred to the casing in which the packer is set via the slips. Thus the slips prevent loading onto any liner or liner hanger located below the slips.

This packer tool, however, has a number of disadvantages. As with all weight-set tools there is a risk that the tool will set in the wrong location if it meets an obstruction in the well bore. As this tool is set by shearing pins and then engaging slips before the packer elements expand, it is difficult to release the tool for repositioning once it has set. Additionally, as the slips move transversely in response to a longitudinally applied force, under excessive longitudinal loading, which can be experienced at high pressure differentials, the slips can loose grip and thus there is a risk of the full force landing on the liner top.

SUMMARY OF THE INVENTION

It is an object of the present invention to provide a compression set packer which includes a mechanism to take up excess force created by the pressure differential during an in-flow test.

It is an object of at least one embodiment of the present invention to provide a compression set packer which prevents force from the pressure differential being applied to a liner top.

According to a first aspect of the present invention there is provided a packer tool for mounting on a work string to provide a seal against a tubular, the packer tool comprising a body with one or more packer elements and a sleeve, the packer tool being set by movement of the sleeve relative to the tool body compressing the one or more packer elements, wherein the tool has a plurality of bypass channels to provide a fluid path past the packer elements and wherein the sleeve includes at least one anchoring member, the at least one anchoring member being actuable to contact the tubular by fluid pressure from the bypass channels when the packer is set.

Thus a flow path exists in the tool past the packer elements at all times. When the elements are set, the fluid pressure is used to actuate anchoring means against a wall of the well bore to prevent excess loading below. Increased flow pressure caused by a pressure differential at the elements is used to further secure the anchoring means. Further the existence of a flow path around the packer elements reduces surging and swabing when the tool is run-in and pulled out of the well bore.

Preferably the at least one anchoring member is a moveable pad. Preferably there are three pads equidistantly arranged around the sleeve. Preferably the pads are arranged to move radially with respect to a longitudinal axis of the tool. Preferably each pad includes a gripping surface to engage the tubular. Advantageously each pad is part cylindrical, with the curved face being the gripping surface. Preferably a radius of curvature of the gripping surface matches a radius of curvature of the tubular. Preferably also each pad includes a rear surface against which fluid pressure can act to move the pad.

The tool may include restraining means. The restraining means may be one or more springs which bias the/each pad toward the sleeve. The springs may be a pair of leaf springs arranged longitudinally on either side of each pad. The restraining means prevents the pads from engaging the tubular wall when the tool is run-in the tubular.

Preferably the sleeve includes a plurality of ports, each port being arranged between an inner and an outer surface of the sleeve. Preferably, when the packer is not set, the ports align with a base of the bypass channels so that fluid bypassing the packer elements passes to the outer surface of the sleeve. Preferably also, when the packer is set, the ports are closed by virtue of their movement away from the bypass channels.

Preferably, closure of the ports directs the fluid bypassing the packer elements and transfers the fluid pressure to the anchoring means. More preferably the directed fluid flows through one or more channels in the sleeve to exert the fluid pressure upon the rear surface of the pads.

Preferably the sleeve includes one or more recesses arranged longitudinally on the outer surface. The recesses provide fluid flow past the sleeve as the tool is run in a well bore.

The packer may include a shoulder on an outer surface. More preferably the shoulder is located on the outer surface of the sleeve. The shoulder provides an abutment surface for a liner top if located at the packer tool. Preferably the liner top is a polished bore receptacle.

Preferably the one or more packer elements are made from a moulded rubber material.

The sleeve may be mechanically linked to the body of the tool by a shear means, wherein the shear means is adapted to shear under the influence of setting down weight on the tool when the shoulder co-operates with the formation.

The sleeve may be mechanically linked to the sleeve by a safety trip button which prevents the sleeve from disengaging from the body until the tool has reached the liner top. Such safety trip buttons are as disclosed in WO 03/040516.

Preferably the sleeve is biased away from the packer element. Preferably the biasing is achieved by a spring. More preferably the spring is located in the channels to the pads.

Preferably the packer tool further includes one or more scrapers and/or brushes mounted below the sleeve. The scrapers and/or brushes clean ahead of the packer elements and prepare the area that the tool is to be set in.

Preferably the work string is a drill string. The drill string may also include dedicated well clean up tools.

According to a second aspect of the present invention there is provided a method for setting the packer tool of the first aspect in a well bore, the method comprising the steps of:

a) running the packer tool mounted on a work string into a well bore while allowing fluid to bypass the packer elements via bypass channels in the tool;
b) landing the tool upon a liner top within the well bore;
c) setting down weight on the packer tool to move the sleeve relative to the tool body in order to compress and set the packer elements;
d) diverting the fluid pressure through the bypass channels to actuate anchoring means on the sleeve; and
e) anchoring the tool against a wall of the well bore to limit the load on the liner top.

Preferably the method also comprises the step of performing an inflow or negative test to test the integrity of the well bore.

Preferably the packer elements can be set repeatedly.

Preferably the method further comprises the step of brushing and/or scraping the well bore ahead of packer when running the packer.

Preferably also the method includes the step of inserting the tool within the liner top to engage a safety trip button before retracting the tool to release the safety trip button and allow the sleeve to separate from the body.

According to a third aspect of the present invention there is provided a method of performing an inflow test within a tubular, the method comprising the steps of:

a) setting a compression set packer on a liner top within the tubular;
b) creating a differential pressure between a bore of the liner and an annulus over which the packer element is set;
c) diverting fluid pressure in the annulus through bypass channels around the packer element;
d) using the fluid pressure to actuate anchoring means to secure the compression set packer against the tubular below the packer element to limit loading on the liner top; and
e) monitoring fluid pressure at surface to detect leaks within the liner.

BRIEF DESCRIPTION OF THE DRAWINGS

Example embodiments of the invention will now be illustrated with reference to the following Figures in which.

DETAILED DESCRIPTION OF THE INVENTION

Figure 1:
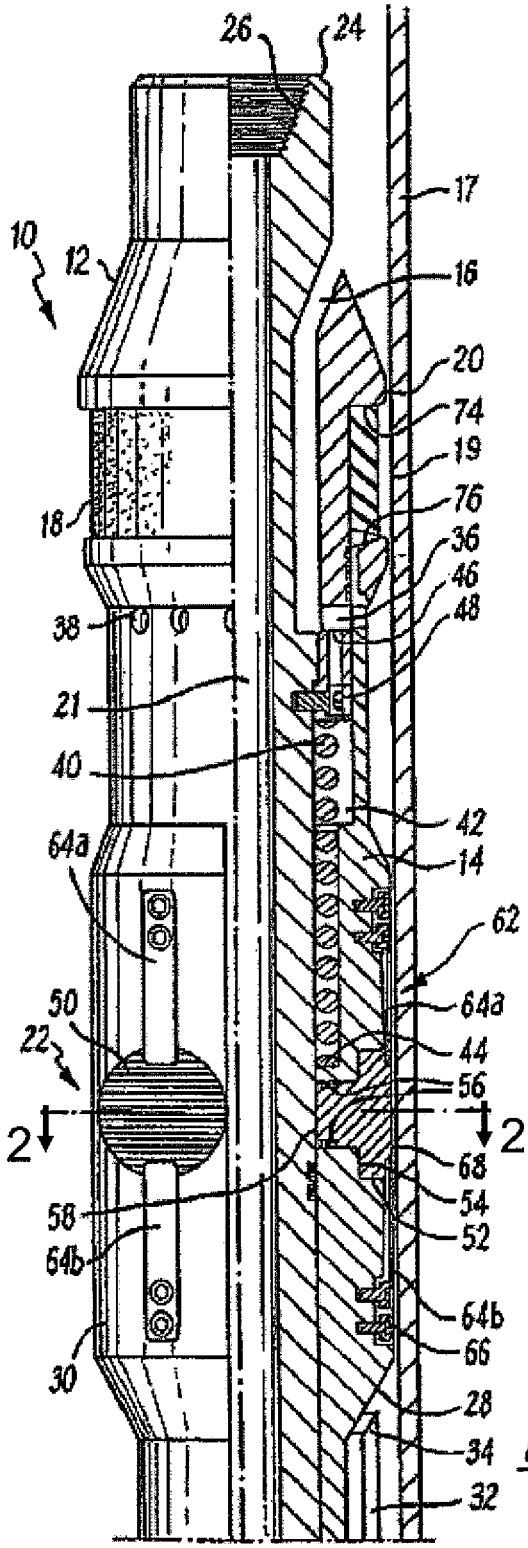
FIG. 1 is a cross-sectional schematic view of a packer tool according to the present invention.

Reference is initially made to FIG. 1 of the drawings which illustrates a packer tool, generally indicated by reference numeral 10, according to the present invention. Packer tool 10 is a compression set packer.

The packer tool 10 comprises a body 12 upon which is arranged a packing element 18 and a sleeve 14. Packing element 18 is in the form of an annular band of rubber which when compressed longitudinally will expand radially, increasing the overall diameter of the tool 10 to provide a seal between the outer surface 20 of the body 12 and a surface 19 within a well bore. Packer tool 10 further includes bypass channels 16 behind the packer element 18 and an anchoring means, generally indicated by reference numeral 22, below the packer element 18.

Tool body 12 is a cylindrical mandrel including a through-bore 21. At an upper end 24, there is located a box section 26 to allow the body 12 to be connected to a work string (not shown). At a lower end of the body 12 there is located a corresponding pin section (not shown) so that the tool 10 can be mounted within the work string. The sleeve 14 includes a shoulder 28 on an outer surface 30 thereof. The shoulder is designed to match and locate on a top 34 of a tubular 32 which may be referred to as a liner top. In the preferred embodiment tubular 32 is a polished bore receptacle and is held in position by a tieback packer as is known in the art. The tieback packer provides a permanent seal below the top 34.

The body 12 further includes a series of ports 36 providing a fluid passageway from the bypass channels 16 to the outer surface 20 of the body 12. The ports 36 are equidistantly arranged around the circumference of the body 12. The sleeve 14 is arranged to cover the ports 36 and has a series of matching ports 38 arranged around its circumference. The ports 38 extend through the sleeve 14. In this way, when ports 38 are aligned with ports 36 fluid travelling through the channels 16 can pass from the channels 16 through the ports 36, 38 into the well bore. Equally fluid pressure can be transferred through fluid within the channels 16.

Sleeve 14 is initially held to the body 12 by a shear pin 48. Shear pin 48 provides a mechanical link between the sleeve 14 and the body 12. The shear line for the pin is on the outer surface 20 of the body and when split the pin is retained within the sleeve 14. With the shear pin 48 in place, the ports 36,38 are aligned and fluid bypasses the packer element 18 and is returned to the well bore.

In an alternative embodiment the sleeve 14 is held to the body 12 by a safety trip button. Such a safety trip button is that disclosed in WO 03/040516 which is incorporated herein by reference. The button operates between the tool body 12 and a sleeve 14 of the tool, locking them initially together. When the tool reaches a liner top in a well bore, the button engages the liner which unlocks the body and sleeve. The button is kept in the unlocked position by virtue of the liner while the tool is set. The button prevents premature setting of the tool.

The sleeve 14 is moved by virtue of the shoulder 28 contacting the liner top 34, and weight being set down on the work string. Sleeve 14 is biased away from the packer element 18 via a spring 40 located in a channel 42, thus the spring 40 is compressed as the sleeve 14 is moved. Channel 42 is longitudinally arranged between the sleeve 14 and the body 12. Channel 42 has a lower lip 44 against which spring 40 is biased and an upper opening 46 which aligns with the port 36 in the body 12. In the embodiment shown there are three channels 42. However, any number of channels or reservoirs may be incorporated. Fluid pressure in the bypass channel 16 will be directed through the opening 46 to travel through the channels 42 if the ports 38 are closed by virtue of being misaligned with the ports 36.

Channels 42 extend into the anchoring section 22 and end behind three pads 50 located on the sleeve 14. Thus fluid pressure guided through each channel 42 can impinge on a rear surface 58 of each pad. Each pad 50 lies in a recess 52 on the outer surface 30 of the sleeve 14. Each recess 52 is shaped to provide a lip 54 to prevent the pad from moving into the body 12. Recess 52 includes seals 56 so the fluid behind each pad 50 will not travel between the pad 50 and the recess 52 to escape from the tool 10. Each pad 50 can therefore be moved radially outward from the sleeve 14 by virtue of fluid pressure reaching the rear surface 58.

On actuation of the pads 50, by increased fluid pressure through the channels 42, each pad 50 moves as a piston, radially outwards and contacts the surface 19 in the well bore. Each surface 60 with moving pads 50 is serrated to provide a gripping surface such as would be found on slips and the like so that pads 50 adhere to the surface 19.

Further, restraining means, generally indicated by reference numeral 62, are attached to each pad also. In the embodiment shown the restraining means comprises two leaf springs 64*a,b* arranged longitudinally on either side of each pad 50. Each spring 64 is bolted 66 at one end to the pad 50 and is located under the surface 68 of each pad 50 at the other end. The springs 64*a,b* bias the pad 50 into the recess 52.

There are three pads 50 arranged equidistantly on the outer surface 30 of the sleeve 14. It will be appreciated by those skilled in the art that the pads could be staggered upon the surface 30 and various numbers of pads could be used. Each pad 50 has an outer surface 38 which is part cylindrical, as seen with the aid of FIG. 2. The curvature of the outer surface 68 matches the radius of curvature of the surface 19 to which it adheres.

On the outer surface 30 of the sleeve 14 at the anchoring means 62 there are arranged longitudinal recesses 70 between the pads 50. The recesses reduce the diameter of the sleeve so that fluid can always flow past the sleeve 14 at the anchoring means 62.

In use, tool 10 is located in a work string using the box section 26 and the pin section (not shown). The work string is then run into casing 17 until the tool 10 reaches a liner top 34. During run in the ports 36,38 are aligned and fluid can pass around the packer elements 18 in an upward direction to achieve a faster run-in rate as the surge effect is reduced. This also allows the tool to have a diameter closer to the tubular diameter. On reaching the liner top 34, shoulder 28 of the tool 10 contacts the liner top 34. Weight set down on the work string causes the sleeve 14 to be arrested at the liner top 34 while the body 12 moves downwards relative to the sleeve 14. This relative movement causes sufficient force to break the shear pin 48 so that the sleeve 14 and body 12 are released from each other. With the sleeve arrested, the downward movement of the body causes a shoulder 74 of the body 12 to move against the packer element 18. Packer element 18 will expand radially under the compression caused from the shoulder 74 moving towards a shoulder 76 on the sleeve 14 at the opposite side of the element 18. Continued compression will result in the packer element expanding until it meets the surface 19 of the casing 17. At this point the element 18 provides a seal within the well bore in the annulus between the tool 10 and the casing 17.

This movement of the sleeve 14 misaligns the port 36, 38 and therefore blocks the exit of port 36 into the well bore and instead opens into the channels 42 which end at the rear surface 58 of the pads 50. As a result, fluid pressure in the annulus above the packer 18 will cause the pads 50 to move radially outwards to contact surface 19 of the casing 17. This anchors the sleeve 14 within the well bore. Such fluid pressure is created as the pressure differential is induced to perform an in-flow test.

In particular, as the sleeve is now fixed, the shoulder 28 is held at the liner top 34. The fluid pressure at the packer 18 now directed to the pads 50. Thus, any load transmitted through the packer element 18 to the sleeve 14 will be borne by the pads 50 and thus the liner top 34 is prevented from any additional pressure. Thus all load is now tied back to the tubular. Further, as the pressure is applied radially to the pads 50, by virtue of pressure applied to their rear surfaces 42, the pads cannot slip as there is no longitudinal loading applied.

With the ports 36,38 misaligned, the well bore within the casing 17 is now sealed by the packer element 18. An in-flow or negative test can be performed. The pressure differential created in the annulus will be used to secure the pads 50 to the tubular.

Figure 2:
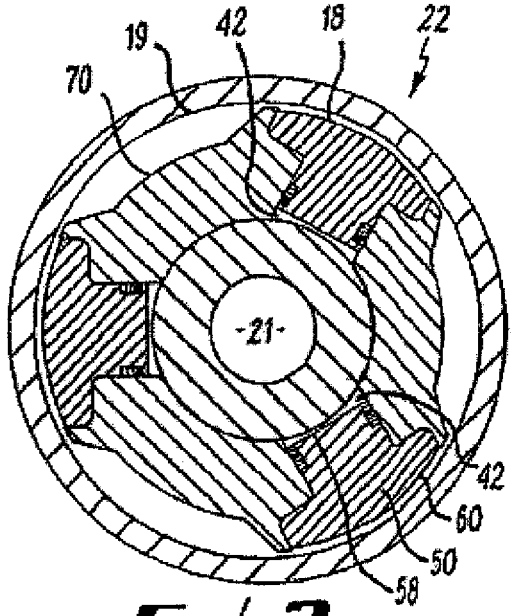
FIG. 2 is a sectional view through the line 2-2 of FIG. 1.
Figure 3:
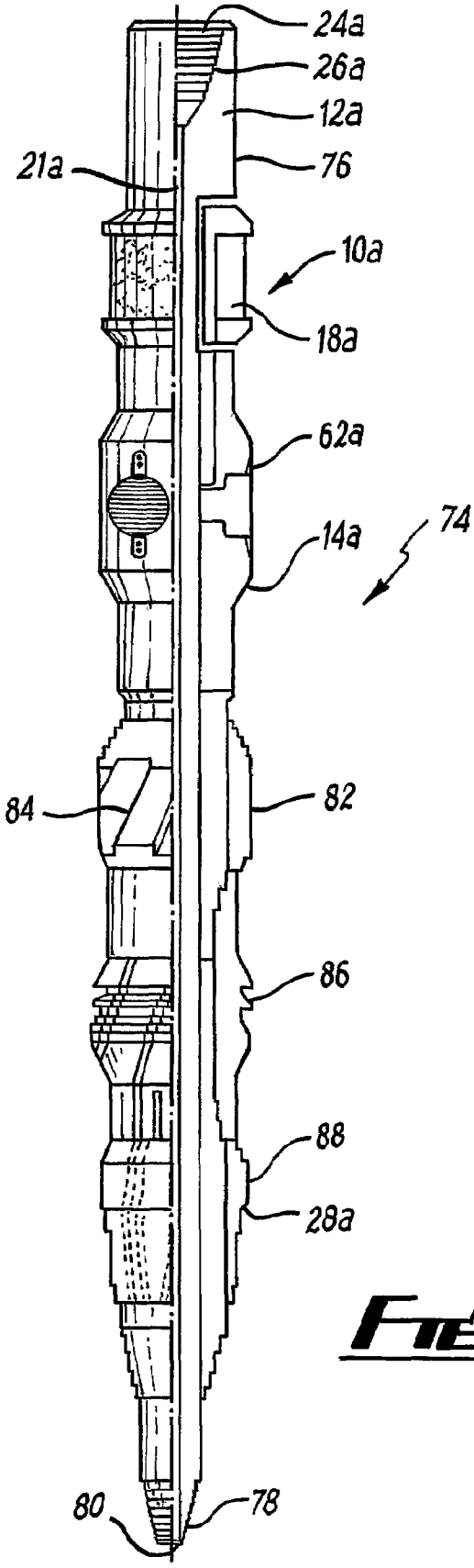
FIG. 3 illustrates a further embodiment of a packer tool according to the present invention.

Reference is now made to FIG. 3 of the drawings which illustrates a packer tool, generally indicated by reference numeral 74, in accordance with an embodiment of the present invention. Like parts of FIG. 3 to those of FIGS. 1 and 2 have been given the same reference numeral but are now suffixed "a".

Packer tool 74 comprises a one piece full length drill pipe mandrel 76 comprising a body 12*a* with a longitudinal bore 21*a* therethrough. A box section 26*a* is located at the top end 24*a* of the mandrel 76 and a corresponding pin section 78 is located at the lower end 80 of the mandrel 76. Sections 24*a*, 78 provide for connection of the packer tool 74 to upper and lower sections of a drill pipe or work string (not shown).

Mounted on the body 12*a* of the mandrel 76 is a packer tool 10*a*, described hereinbefore with reference to FIGS. 1 and 2. Below the packer tool 10*a* is located a stabilizer sleeve 82. Sleeve 82 is rotatable in respect to the mandrel 76. Raised portions or blades 84 on the sleeve 82 provide a "stand off" for the tool 74 from the walls of the well bore and reduce friction between the two during insertion into the well bore.

Located below the stabilizer sleeve 82 is a Razor Back (Trade Mark) lantern 86. This Razor Back lantern (Trade Mark) provides a set of scrapers for cleaning the well bore prior to setting the packer 18*a*. Though scrapers are shown, brushing tools such as a Bristle Back (Trade Mark) could be used instead of or in addition to the scrapers.

The shoulder 28*a* for operating the sleeve 14*a* of the packer 10*a* is located on a top dress mill 88 at the lower end of the tool 74. The shoulder 28*a*, via abutting surfaces through the intermediary sections 88, 86, 82 acts on the sleeve 14*a* operation of the tool 74 is achieved through landing the shoulder 28*a* on a formation, such as a polished bore receptacle, to move the sleeve 14*a* relative to the body 12*a* as described hereinbefore. The presence of the top dress mill 88 allows the polished bore receptacle to be dressed prior to setting a packer.

The principal advantage of the present invention is that it provides a compression set packer tool to seal by a liner top within a well bore which prevents excess weight or force being placed on the liner top 34.

Advantageously, fluid pressure in the well bore is used to energize and maintain an anchoring device which holds the tool at the liner top once the compression set packer has set.

Additionally by anchoring the tool below the packer element after the packer has been set the anchoring means of the present invention can be released so that the anchor is retracted, the packer elements are released from the well bore surface and the tool and work string can be easily removed from the well bore.

Additionally, the use of bypass channels around the packer element allows the tool to be dimensioned close to the inner diameter of the tubular without experiencing problems of surging and swabbing.

Various modifications may be made to the invention herein disclosed without departing from the scope thereof. In particular, the number, position and shape of the anchoring pads used can be varied. Additionally while longitudinal channels are described to connect the bypass channels to the rear surfaces of the pads, a single channel in the form of a reservoir could alternatively be used so that the pressure on the pads is equalized for use.

Where the packer tool comprises a one piece full length drill pipe mandrel, with items such as a stabilizer sleeve, razorback lantern and a mill, the packer tool may alternatively be actuated through a shoulder on the tool being set down on a liner (or other tubular) top. The other items may therefore be dimensioned to pass into the liner; in this situation, the mill may be provided as a stabilizer sleeve mill.

The invention claimed is:

1. A packer tool for mounting on a work string to provide a seal against a tubular, the packer tool comprising:

a body with one or more packer elements and a sleeve, the packer tool being set by movement of the sleeve relative to the tool body compressing the one or more packer elements, wherein the tool has a plurality of bypass channels to provide a fluid path past the packer elements, and wherein the sleeve includes at least one anchoring member, and configured such that the at least one anchoring member is actuable by fluid pressure from the bypass channels when the packer is set to contact the tubular below the packer elements.

2. The packer tool as claimed in claim 1, wherein the at least one anchoring member is a moveable pad.

3. The packer tool as claimed in claim 2, further comprising three pads equidistantly arranged around the sleeve.

4. The packer tool as claimed in claim 2, wherein the pad is arranged to move radially with respect to a longitudinal axis of the tool.

5. The packer tool as claimed in claim 2, wherein the pad includes a gripping surface to engage the tubular.

6. The packer tool as claimed in claim 5, wherein the pad has a cylindrical portion, with a curved face of the cylindrical portion being the gripping surface.

7. The packer tool as claimed in claim 6, wherein a radius of curvature of the gripping surface matches a radius of curvature of the tubular.

8. The packer tool as claimed in claim 2, wherein the pad includes a rear surface against which fluid pressure can act to move the pad.

9. The packer tool as claimed in claim 2, the packer tool further including restraining means configured to restrain the pad from engaging a wall of the tubular when the tool is run-in the tubular.

10. The packer tool as claimed in claim 9, wherein the restraining means is one or more springs which bias the pad toward the sleeve.

11. The packer tool as claimed in claim 1, wherein the sleeve includes a plurality of ports, each port being arranged between an inner and an outer surface of the sleeve.

12. The packer tool as claimed in claim 11, wherein when the packer is not set, the ports align with a base of the bypass channels so that fluid bypassing the packer elements passes to the outer surface of the sleeve.

13. The packer tool as claimed in claim 11, wherein when the packer is set, the ports are closed by virtue of their movement away from the bypass channels, thereby directing the fluid bypassing the packer elements and transferring the fluid pressure to the at least one anchoring member.

14. The packer tool as claimed in claim 13, wherein a directed fluid flows through one or more channels in the sleeve to exert the fluid pressure upon the rear surface of the pads.

15. The packer tool as claimed in claim 14, wherein the sleeve is biased away from the packer element.

16. The packer tool as claimed in claim 1, wherein the sleeve includes one or more recesses arranged longitudinally on an outer surface to provide fluid flow past the sleeve as the tool is run in a well bore.

17. The packer tool as claimed in claim 1, including a shoulder on an outer surface.

18. The packer tool as claimed in claim 17, wherein the sleeve is mechanically linked to the body of the tool by a shear means.

19. The packer tool as claimed in claim 18, wherein the shear means is adapted to shear under the influence of setting down weight on the tool when the shoulder co-operates with a formation.

20. The packer tool as claimed in claim 1, further including one or more scrapers and/or brushes mounted below the sleeve.

21. A method for setting a packer tool in a well bore, the packer tool comprising a tool body with one or more packer elements and a sleeve, the method comprising the steps of:

(a) running the packer tool mounted on a work string into a well bore while allowing fluid to bypass the packer elements via bypass channels in the tool;

(b) landing the packer tool upon a liner top within the well bore;

(c) setting down weight on the packer tool to move the sleeve relative to the tool body in order to compress and set the packer elements;

(d) diverting a fluid pressure through the bypass channels to actuate anchoring means on the sleeve; and (e) anchoring the tool against a wall of the well bore to limit the load on the liner top.

22. The method as claimed in claim 21, further comprising the step of performing an inflow or negative test to test the integrity of the well bore.

23. The method as claimed in claim 21, further comprising the step of brushing and/or scraping the well bore ahead of the packer tool when running the packer tool.

24. The method as claimed in claim 21, including the step of inserting the packer tool within the liner top to engage a safety trip button before retracting the packer tool to release the safety trip button and allow the sleeve to separate from the tool body.

25. A method of performing an inflow test within a tubular, the method comprising the steps of:

(a) setting a compression set packer on a liner top within the tubular;

(b) creating a differential pressure between a bore of the liner and an annulus over which the packer element is set;

(c) diverting fluid pressure in the annulus through bypass channels around the packer element;

(d) using the fluid pressure to actuate anchoring means to secure the compression set packer against the tubular below the packer element to limit loading on the liner top; and (e) monitoring fluid pressure at surface to detect leaks within the liner.

* * * * *